United States Patent [19]

Singer

[11] Patent Number: 4,597,604

[45] Date of Patent: Jul. 1, 1986

[54] SUPPORT STRUCTURES FOR CHAIRS AND THE LIKE HAVING PIVOTING MEMBERS

[76] Inventor: Mark Singer, 15 Madison St., Cambridge, Mass. 02138

[21] Appl. No.: 567,231

[22] Filed: Dec. 30, 1983

[51] Int. Cl.[4] ..... A47C 4/00

[52] U.S. Cl. ..... 297/18; 297/291

[58] Field of Search ..... 297/18, 24, 25, 26, 297/291, 292

[56] References Cited

U.S. PATENT DOCUMENTS

| | | | |
|---|---|---|---|
| 306,989 | 10/1884 | Yandell | 297/18 |
| 478,131 | 7/1892 | Richards et al. | 297/291 |
| 571,536 | 11/1896 | Neuens | 297/291 X |
| 585,422 | 6/1897 | Boenning | 297/18 |
| 1,539,225 | 5/1925 | West et al. | 297/18 |
| 1,969,313 | 8/1934 | Meeker . | |
| 2,242,081 | 5/1941 | Long | 297/18 |
| 2,295,122 | 9/1942 | Moeller | 297/18 X |
| 3,154,344 | 10/1964 | Stableford | 297/18 |
| 4,118,064 | 10/1978 | Robeson . | |
| 4,251,106 | 2/1981 | Gilbert . | |

FOREIGN PATENT DOCUMENTS

| | | | |
|---|---|---|---|
| 120817 | 5/1901 | Fed. Rep. of Germany | 297/18 |

*Primary Examiner*—Francis K. Zugel

[57] ABSTRACT

A chair support structure including a pair of transversely spaced struts maintained in substantially fixed relationship to each other, the axes of the struts being inclined with respect to the horizontal and defining an imaginary surface therebetween, an integral rigid member having two upper end portions spaced from each other and two lower end portions spaced from each other and being inclined oppositely to said struts with respect to the horizontal and positioned intermediate the struts to intersect the surface defined thereby, a first tension member connecting the integral rigid member at its upper end portions with the struts at a position above said intersection, a second tension member connecting the integral rigid member at its lower end portions to the struts near their bottoms, and a third tension member connecting the integral rigid member to the struts above said intersection in a position different from said first tension member to gradually inhibit forward pivoting. Also disclosed is a chair including a seat cushion that tilts relative to the horizontal and a back pivotally connected to a back support to compensate for tilting of the seat cushion.

11 Claims, 2 Drawing Figures

SUPPORT STRUCTURES FOR CHAIRS AND THE LIKE HAVING PIVOTING MEMBERS

FIELD OF THE INVENTION

The invention relates to support structures for chairs and the like.

BACKGROUND OF THE INVENTION

Some chair support structures have been constructed solely of pure tension members and pure compression members. For example, rocking chairs have been provided by support structures having two rigid (i.e., compression) members that each have upper end portions that are spaced from each other and lower end portions that are spaced from each other. The rigid members are oppositely inclined with respect to the horizontal, intersecting each other in side view, and one of the rigid members is positioned intermediate the other. The rigid members are connected to each other near their bottoms by one pair of flexible tension members that prevent the bottoms from sliding apart, and they are also connected above where they intersect by another pair of flexible tension members that prevent the rigid members from falling owing to gravity. The rigid members can pivot about their points of contact with the ground, providing the rocking movement.

Meeker U.S. Pat. No. 1,969,313, Robeson U.S. Pat. No. 4,118,064 and Gilbert U.S. Pat. No. 4,251,106 disclose examples of such support structures for rocking type chairs having seating surfaces provided by sling-type flexible sheets suspended between the upper ends of the rigid members. Meeker and Robeson disclose structures in which each rigid member is a pair of parallel struts connected to each other by horizontal bars and teach that the structures can be modified to prevent rocking by adding pin connections between the rigid members where they intersect. Gilbert discloses a structure in which the rigid member that is longer than the other has a central portion that branches at the lower end to provide two feet and at the upper end to support a sling-type seating surface flexible sheet that also acts as an upper tension member preventing the rigid members from falling owing to gravity; backward pivoting is prevented beyond a certain point by interference of the branched lower ends of the longer rigid member with the diverging lower ends of the other rigid member, and forward pivoting is prevented beyond a certain point by a pair of cords between the rigid members at positions to the rear of where they intersect each other in side view.

SUMMARY OF THE INVENTION

In general the invention features in one aspect a support structure for a chair or the like including a pair of transversely spaced struts maintained in substantially fixed relationship to each other, the axes of the struts being inclined with respect to the horizontal and defining an imaginary surface therebetween, an integral rigid member having two upper end portions spaced from each other and two lower end portions spaced from each other and being inclined oppositely to said struts with respect to the horizontal and positioned intermediate the struts to intersect the surface defined thereby, a first tension member connecting the integral rigid member at its upper end portions with the struts at a position above said intersection, a second tension member connecting the integral rigid member at its lower end portions to the struts near their bottoms, and a third tension member connecting the integral rigid member to the struts above said intersection in a position different from said first tension member to gradually inhibit forward pivoting.

In preferred embodiments, the third tension member is connected to the struts at or near the connection to them of the first flexible tension member and is connected to the integral rigid member at a position about half way between the location where the integral rigid member intersects the imaginary surface and the upper ends of the integral rigid member; the first tension member is substantially horizontal; a seat cushion is partially supported by the first tension member and is partially supported by a horizontal rigid member between the struts; the first tension member is a flexible sheet; and the struts are curved above the seat cushion so as to provide support for a chair back at a steeper angle from the horizontal than the angle made by the struts below the first connection position.

In another aspect the invention features a chair including a support structure having legs and a back support, a seat cushion supported by the legs for tilting relative to the horizontal, and a back pivotally connected to the back support to compensate for tilting of the seat cushion.

DESCRIPTION OF THE PREFERRED EMBODIMENT

I turn now to description of the structure and operation of the preferred embodiment, after first briefly describing the drawings.

DRAWINGS

STRUCTURE

Figure 1:
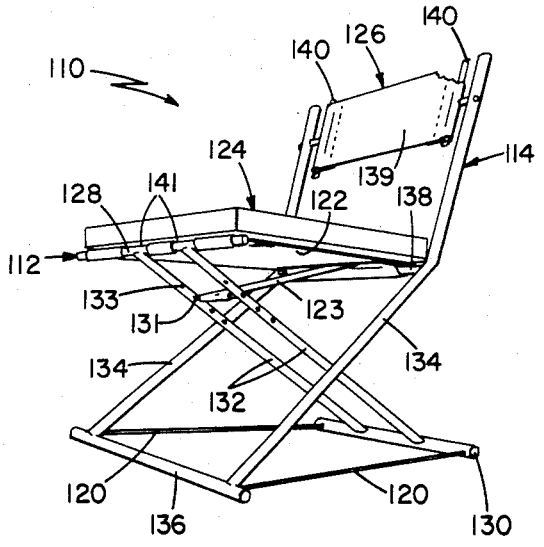
FIG. 1 is an isometric view, partly broken away, of a chair according to the invention.
Figure 2:
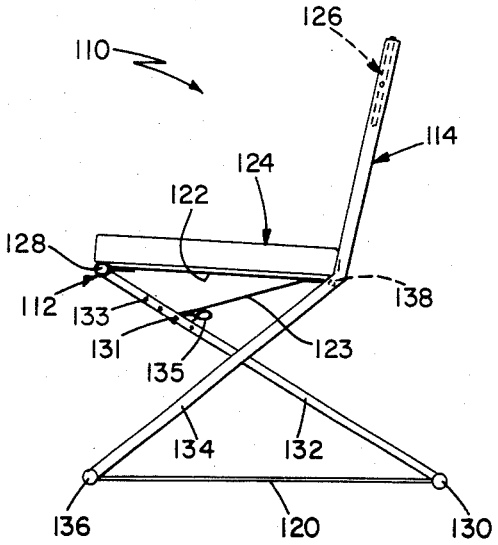
FIG. 2 is a side elevation, partly broken away, of the FIG. 1 chair.

Referring to FIGS. 1 and 2, chair 110 includes oppositely inclined rigid members 112, 114, flexible tension cables 120, flexible tension member 122, flexible tension member 123, seat cushion 124, and pivotal chair back 126.

Rigid member 112 includes upper horizontal tubular member 128, lower horizontal tubular member 130, spaced interconnecting inclined tubular members 132 welded to members 128, 130, and intermediate horizontal member 131, bolted to inclined tubular members 132 at the holes 133 located about one-fourth of the distance from upper tubular member 128 to lower tubular member 130. Other holes 133 for securing tubular member 128 in different positions are provided between bar 128 and where rigid member 112 intersects an imaginary planar surface through struts 134.

Rigid member 114 includes tubular doglegged struts 134 connected by horizontal tubular members 136 and 138 welded between them. Struts 134 are inclined approximately 30° from the horizontal at their portions below tubular member 138. Above tubular member 138, struts 134 are curved to provide upper portions making a steeper incline with the horizontal to provide support at the proper position for pivotal chair back 126, made of fabric 139 tautly suspended between two generally vertical tubular support members 140, pivotally connected to the upper portions of struts 134 and received in tunnels created by stitching of fabric 139.

Flexible tension member 122 is made of fabric stitched near horizontal tubular members 128, 138, creating tunnels receiving these members. Member 122 has two holes 141 through which tubular members 132 pass and supports seat cushion 124 on its upper surface. Flexible tension member 123 is stitched to member 122 near tubular member 138 and has a plurality of stitched tunnels 135 for receiving intermediate horizontal tubular member 131, the tunnel 135 being used depending upon which holes 133 member 131 is bolted through.

Cables 120 are connected between positions on tubular members 130, 136 near their ends, and are connected to the tubular members by ball shank terminals on the cables that lock in key-shaped apertures in the tubular members.

Cushion 124 includes ⅛ inch thick acrylic plastic support plate and overlying foam (not shown), both of which are covered by fabric. Velcro fasteners (not shown) secured to the bottom of cushion 124 near the front and back engage mating fasteners on flexible tension member 122 near tubular members 128, 138.

OPERATION

In use, cables 120 prevent rigid members 112, 114 from sliding away from each other on the floor; flexible tension member 122 supports cushion 124 and prevents rigid members 112, 114 from falling owing to gravity, and flexible tension member 123 inhibits forward pivoting of rigid members 112, 114.

In the position shown in FIGS. 1 and 2, a person sitting on chair 110 causes seat cushion 124 to deflect slightly, owing to the resilient nature of its support plate. A substantial amount of the person's weight is transmitted downward directly to horizontal bars 128, 138, causing tension in flexible tension member 122, and the remainder of the weight is transmitted to members 128, 138 through tension member 122, because the slight deflection of the support plate causes cushion 124 to contact flexible tension member 122, causing increased tension in it and also causing the upper portions of rigid members 112, 114 to move toward each other slightly. (If cushion 124 did not include a support plate, a person sitting on chair 110 would be virtually entirely supported by flexible tension member 122, causing the upper portions of flexible members 112, 114 to move closer together. If the support plate of cushion 124 were rigid, it would be entirely supported directly by horizontal tubular members 128, 138.) In the position shown in the figures, flexible tension member 123 does not bear any tension, and may even be visibly limp in use, owing to the fact that members 112, 114 have moved toward to each other slightly, owing to deflection of tension member 122 when a person is sitting on cushion 124.

If the person leans backward, seat cushion 124 tilts backward, and seat back 126 pivots clockwise, providing a natural angle relative to the new position of seat cushion 124, even though the upper portions of struts 134 are at a sharper angle relative to cushion 124. Backward pivoting is not inhibited by flexible tension member 123, because rigid horizontal members 131, 138 on which it is supported move closer together. A person will not tip over backward without taking some drastic action such as sitting on seat back 126 and leaning backward, because otherwise the person's center of gravity will be located forward of rear horizontal member 130.

If the person sitting in the chair leans forward, flexible tension member 123 inhibits forward pivoting. Owing to the fact that tension member 123 is connected between the end of member 112 and where it intersects an imaginary plane surface between struts 134, the inhibiting of forward pivoting is gradual. Forward pivoting beyond a certain point is absolutely prevented by tension member 123.

Because the support plate is resilient, the switchover of tension from member 122 to 123 is gradual during forward pivoting. During forward pivoting, as tension member 123 begins to be placed in tension, the decrease in tension in member 122 permits further sagging of the support plate, in turn causing members 112, 114 to move together slightly, something tending to decrease tension in tension member 123. This adjusting causes a period of transition in which tension is shared by both tension members 122, 123 and is gradually transferred from tension member 122 to tension member 123. (If the plate were completely rigid, and all the weight were thus directly transmitted downward to horizontal members 128, 138, the switchover of tension from tension member 122 to tension member 123 would be abrupt, tension member 122 going limp as tension member 123 takes over, and the stopping of forward pivoting might similarly be more abrupt.)

By moving horizontal tubular member 131 to different holes 133 and using different tunnels 135, the abruptness of the inhibiting of forward travel and the position of final forward pivoting can be adjusted, the further away from tubular member 128, the more abrupt the inhibiting will be. If tension member 123 is connected very close to tubular member 128, it will essentially duplicate the action of tension member 122. Thus the holes 133 located about half way between tubular member 128 and the intersection of the imaginary plane through struts 134 by rigid member 112 are preferred for providing significant inhibiting of forward pivoting in a gradual manner.

OTHER EMBODIMENTS

Other embodiments of the invention are within the scope of the following claims.

What is claimed is:

1. A support structure for a piece of furniture comprising a pair of transversely spaced rigid struts, the axes of said struts being inclined with respect to the horizontal and defining an imaginary planar surface passing through said struts, a rigid member between said struts maintaining them in substantially fixed relationship to each other, an integral rigid members, oppositely inclined with respect to the horizontal, having two upper end portions spaced from each other and two lower end portions spaced from each other and spaced from said struts, said integral rigid member intersecting said imaginary surface, a first flexible tension member connecting said integral rigid member at or near its said upper end portions to said struts at a first connection position on said struts above where said integral rigid member intersects said imaginary surface, a second flexible tension member connecting said integral rigid member at or near said two lower end portions to said struts at or near their bottoms, and a third flexible tension member connecting said struts at or near said first connection position to said integral rigid member above where said integral rigid member intersects said imaginary surface and below where said first flexible tension member is connected to said rigid member in position different from said first tension member to gradually inhibit forward pivoting of said struts and said integral rigid member.

2. The support structure of claim 1 wherein said third tension member is connected to said integral rigid member at a position about half way between where said integral rigid member intersects said surface and said upper ends of said integral rigid member.

3. The support structure of claim 1 wherein said first tension member is substantially horizontal.

4. The support structure of claim 3 further comprising a seat cushion including porous resilient material and a support plate, said cushion being at least partially supported by a first horizontal rigid member between said struts at said first connection position.

5. The support structure of claim 4 wherein said first tension member extends from said first horizontal rigid member and provides at least partial support for said cushion.

6. The support structure of claim 5 wherein said first tension member is a flexible sheet.

7. The support structure of claim 5 wherein said struts are curved above said first connection position so as to provide support for a chair back at a steeper angle from the horizontal than the angle made by said struts below said first connection position.

8. The support structure of claim 6 further comprising an additional second tension member, resulting in a pair of second tension members connected to corresponding positions on said integral rigid member and said struts on opposite sides of said support structure.

9. The support structure of claim 7 wherein said integral rigid member comprises second and third horizontal rigid members connected by an inclined rigid member, the end portions of one said horizontal rigid member being said upper end portions, the end portions of the other said rigid horizontal member being said lower end portions.

10. The support structure of claim 3 further comprising a seat cushion supported by said first flexible tension member so as to tilt relative to the horizontal, and a back pivotally connected to said struts to compensate for tilting of said seat cushion.

11. The chair of claim 1 further comprising means for adjustably connecting said third tension member to different locations on said integral rigid member.

* * * * *